US006233743B1

(12) United States Patent
Cummins

(10) Patent No.: US 6,233,743 B1
(45) Date of Patent: May 22, 2001

(54) MITTEN FOR SECURING A HANDICAPPED PERSON'S HAND TO SKI POLE

(76) Inventor: James M. Cummins, 505 N. Willson Ave., Bozeman, MT (US) 59715

( * ) Notice: Subject to any disclaimer, the term of this patent is extended or adjusted under 35 U.S.C. 154(b) by 0 days.

(21) Appl. No.: 09/627,511

(22) Filed: Jul. 28, 2000

(51) Int. Cl.[7] ..... A41D 19/00
(52) U.S. Cl. ..... 2/160; 2/158
(58) Field of Search ..... 2/158, 159, 160, 2/161.1, 161.5, 163; 294/25; 280/821, 822

(56) References Cited

U.S. PATENT DOCUMENTS

| | | | | |
|---|---|---|---|---|
| 4,400,831 | * | 8/1983 | Rietz | 2/161 |
| 4,488,313 | * | 12/1984 | Delaney | 2/17 |
| 4,698,851 | * | 10/1987 | Dunford et al. | 2/160 |
| 5,092,629 | * | 3/1992 | Bagneres et al. | 280/821 |
| 5,110,154 | * | 5/1992 | Street | 280/822 |
| 5,263,202 | * | 11/1993 | Siberell | 2/336 |
| 5,312,134 | * | 5/1994 | Goode et al. | 280/822 |
| 5,375,263 | * | 12/1994 | Cuccia | 2/158 |
| 5,887,282 | * | 3/1999 | Lenhart | 2/159 |

* cited by examiner

*Primary Examiner*—John J. Calvert
*Assistant Examiner*—Katherine Moran
(74) *Attorney, Agent, or Firm*—Richard C. Conover

(57) ABSTRACT

A mitten for securing a handicapped user's hand to a grip of a ski pole with the thumb of the user extending along one side of the grip, and the fingers of the user extending along the opposite side of the grip. The mitten having a mitt with an arm-receiving portion, a thumb pocket and a separate finger pocket. An arm-securing band is attached to the mitt with the band being provided with connecting portions at opposite ends of the band for connecting the ends of the band together with the band encircling the mitt and the user's arm. The mitten further includes a thumb holding strap having one end sewn to an end of the thumb pocket of the mitt. A quick release buckle is provided for adjusting the length of the thumb holding strap and for releasably connecting the thumb holding strap to the arm-securing band. The mitten further includes a first finger holding strap having an end sewn adjacent an end of the finger pocket. A quick release buckle is provided for adjusting the length of the finger holding strap, and also for connecting the finger holding strap to the arm-securing band. A second finger holding strap has an end sewn adjacent an end of the finger pocket. A quick release buckle is provided for adjusting the length of the second finger holding strap, and also for releasably connecting the second finger holding strap to the arm-securing band.

11 Claims, 4 Drawing Sheets

MITTEN FOR SECURING A HANDICAPPED PERSON'S HAND TO SKI POLE

BACKGROUND OF INVENTION

This invention relates to a mitten used to secure a handicapped person's hand to a ski pole in a normal gripping manner.

The present invention can be used to secure a person's hand to a conventional ski pole when the person has difficulty grasping the ski pole. Further, the present invention could be used with a conventional ski pole used by persons who ski by sitting on a ski-type sled. With this sled, the handicapped person normally uses a pair of outrider skis secured to each arm of the handicapped person to retain balance during skiing.

A conventional outrider ski includes a ski pole having an outrider ski attached at one end in generally an orthogonal relation to the ski pole. A handle grip is provided at the opposite end of the ski pole and extends in a forward direction over the outrider ski. An example of such an outrider ski is shown in U.S. Pat. No. 3,738,674 to Pauls.

However, in using the Pauls device, a handicapped person may not be able to grip the handle grip securely. The present invention includes a mitten having straps for securing a handicap's hand and arm to the ski pole.

SUMMARY OF INVENTION

The present invention provides a mitten for securing a handicapped user's hand to a grip of a ski pole with the thumb of the user extending along one side of the grip, and the fingers of the user extending along the opposite side of the grip. The mitten according to the present invention includes a mitt having an arm-receiving portion, a thumb pocket and a separate finger pocket. An arm-encircling band is attached to the mitt with the band being provided with connecting portions at opposite ends of the band for connecting the ends of the band together with a band encircling the mitt and the user's arm. The mitten further includes a thumb holding strap having one end sewn to an end of the thumb pocket of the mitt. A quick release buckle is provided for adjusting the length of the thumb holding strap and for releasably connecting the thumb holding strap to the arm-encircling band. The mitten further includes a first finger holding strap having an end sewn adjacent an end of the finger pocket. A quick release buckle is provided for adjusting the length of the finger holding strap, and also for connecting the finger holding strap to the arm-encircling band. A second finger holding strap has an end sewn adjacent an end of the finger pocket. A quick release buckle is provided for adjusting the length of the second finger holding strap, and also for releasably connecting the second finger holding strap to the arm-encircling band. In use, the thumb holding strap and the two finger holding straps are wrapped around the grip of the ski pole before being attached to the arm-encircling band.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
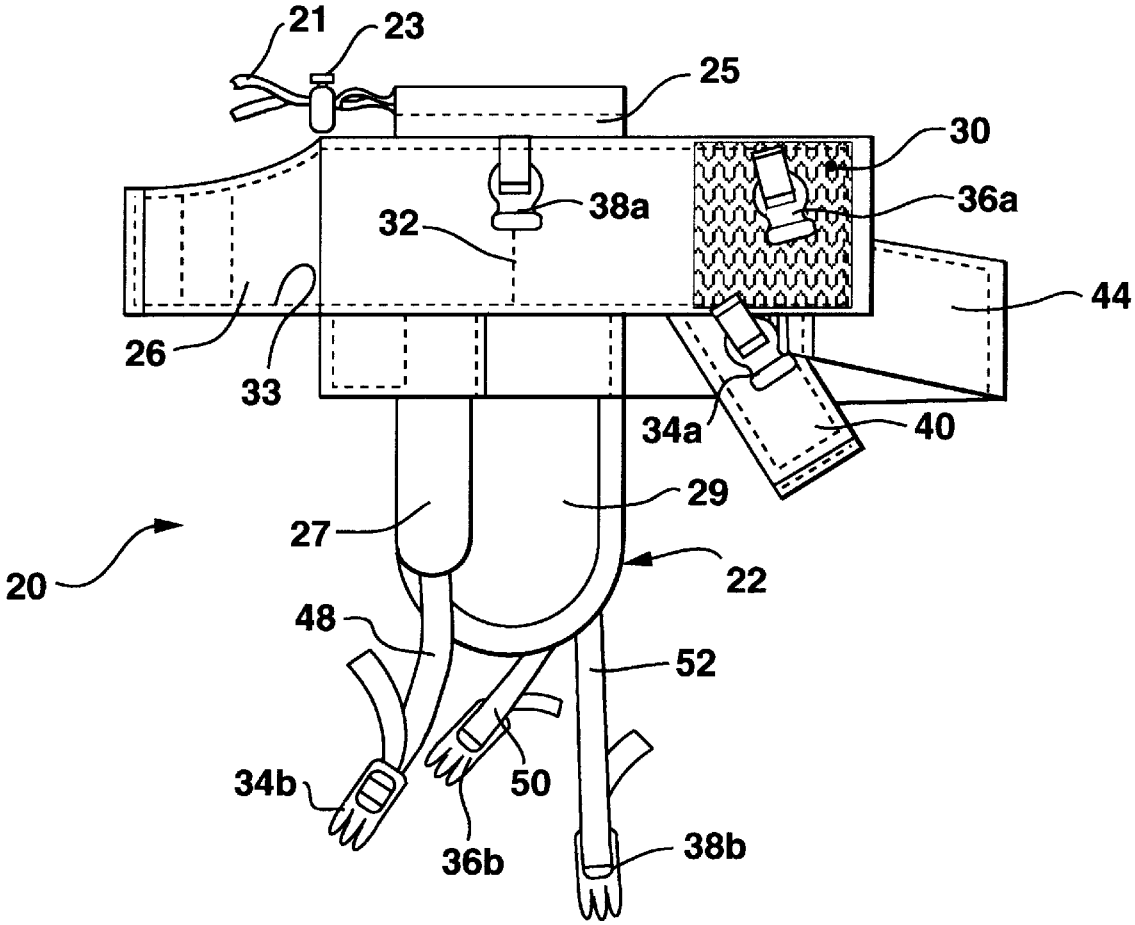
FIG. 1 is an elevational front view of a mitten according to the present invention.

A mitten 20, according to the present invention, is shown in FIGS. 1–4. Mitten 20 includes a conventional ski mitt 22 having a conventional arm-receiving portion 25, a thumb pocket 27 and a conventional finger pocket 29, as shown in FIG. 1. The mitten 20 is further provided with a conventional liner (not shown). Conventional drawstrings 21 are used with a conventional cord lock 23 to close the opening at the top of mitt 22 around an arm of a handicapped person to prevent snow from entering the mitt.

Figure 2:
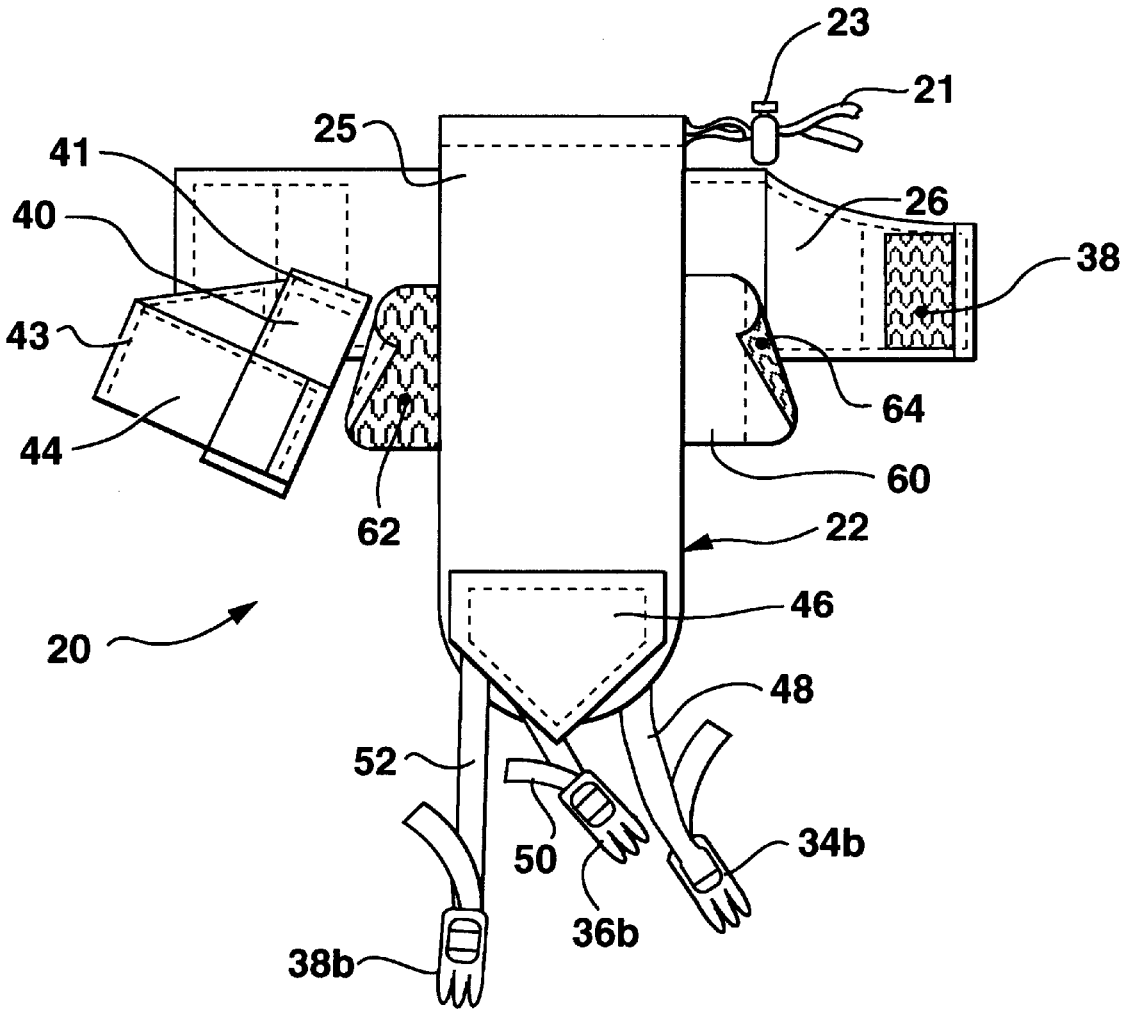
FIG. 2 is an elevational rear view of the mitten shown in FIG. 1.

An arm-securing band 26 is secured to mitt 22 as by sewing with stitches 32, as shown in FIG. 1. Velcro hooks 28 are provided at one end of band 26 as shown in FIG. 2. Velcro loops 30 are provided adjacent the opposite end of band 26 and on an opposite side of band 26 as shown in FIG. 1. Velcro hooks 28 and loops 30 are used to connect the ends of band 26 together encircling the mitt 22 for securing mitt 22 to a user's arm. In a preferred embodiment band 26 is formed from two pieces of material sandwiching a pad material in between. The two pieces of material are sewn together along stitches 33.

A mitt retaining band 60 is secured to mitt 22 sandwiched between mitt 22 and arm-securing band 26 as shown in FIG. 2. Velcro hooks 62 are provided at one end of band 60 as shown in FIG. 2. Velcro loops 64 are provided adjacent the opposite end of band 60 and on opposite side of band 60 as shown in FIG. 2. Velcro hooks 62 and loops 64 are used to connect the ends of band 60 together encircling the mitt 22. A female portion 34*a* of a quick release buckle 34 is sewn to the top of band 26 as shown in FIG. 1. Further, a female portion 36*a* of a quick release buckle 36 is sewn to the top of band 26 as shown in FIG. 1. A female portion 38*a* of a quick release buckle 38 is sewn to band 26 near the bottom of band 26, as shown in FIG. 1.

As shown in FIG. 1, a thumb holding strap 48 has one end sewn to the end of the thumb pocket 27 of mitt 22. A male portion 34*b* of quick release buckle 34 is threaded on to the free end of strap 48 for releasably connecting strap 48 with female portion 34*a*.

A flap 46 is sewn to mitt 22, as shown in FIG. 2. A first finger holding strap 50 has one end sewn to extension 46. A male portion 36*b* of quick release buckle 36 is threaded on to the free end of strap 50 for releasably connecting strap 50 with female portion 36*a*. A second finger holding strap 52 has one end sewn to extension 46 as best seen in FIG. 2. A male portion 38*b* of quick release buckle 38 is threaded on to the free end of strap 52 for releasably connecting strap 52 to female portion 38*a*.

A padding strip 40 is placed at an angle to band 26 and sewn with stitches 41 to band 26 adjacent the buckle 34 as shown in FIG. 1. Padding strip 40 provides padding when buckle 34 is forced toward a user's hand when tightening strap 48.

A padded wrist protector 44 is formed from a strap which is first looped and then has one end sewn to band 26, as shown in FIG. 2. The opposite end of wrist protector 44 is sewn to padding strip 40, as shown in FIG. 2. The mid-section of wrist protector 44 is sewn together with stitches 43, as seen in FIG. 2. The wrist protector 44 provides padding for the wrist of a user when strap 50 is drawn tight.

Figure 3:
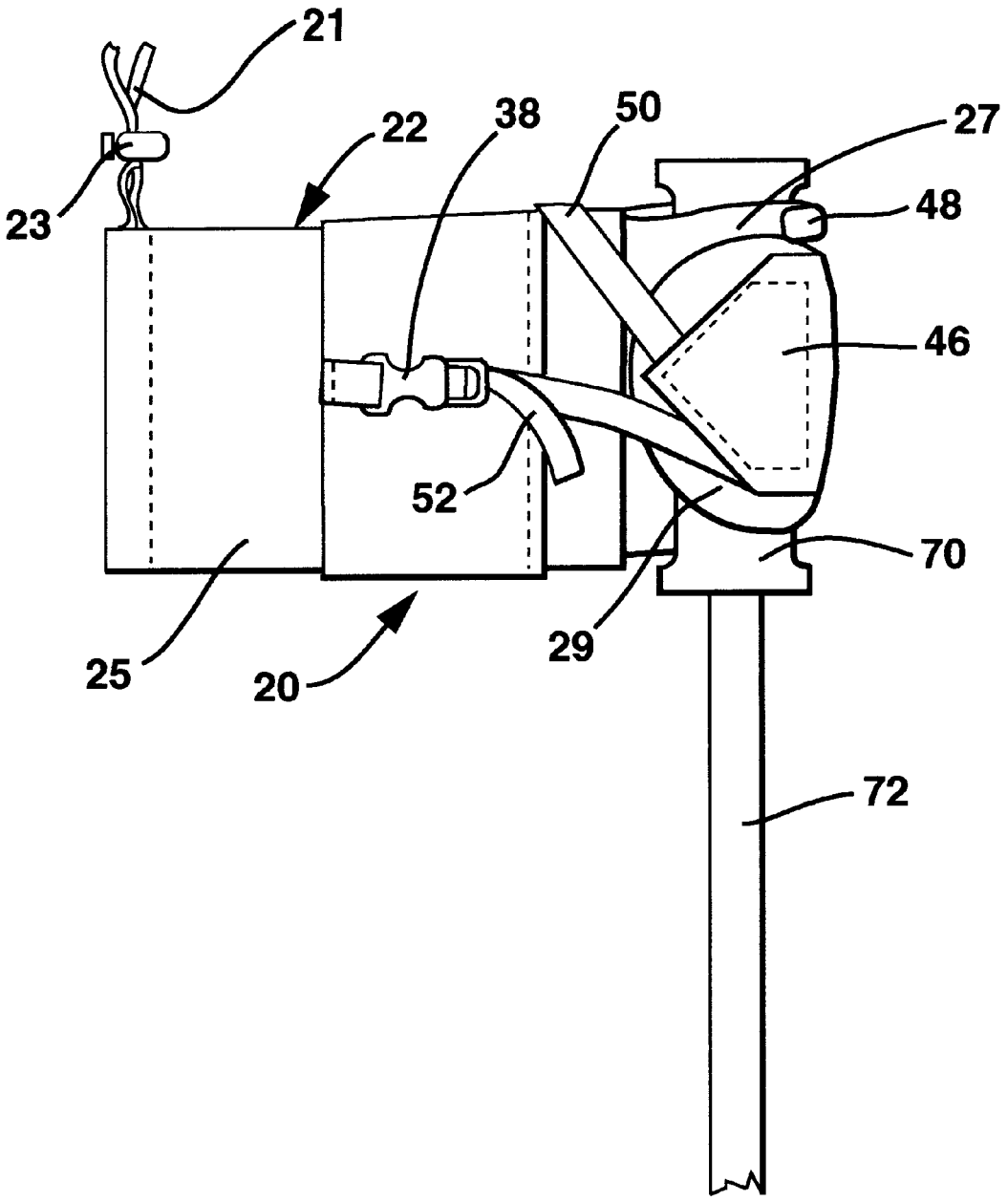
FIG. 3 is an elevational front view showing a mitten according to the present invention assembled on a conventional ski pole.
Figure 4:
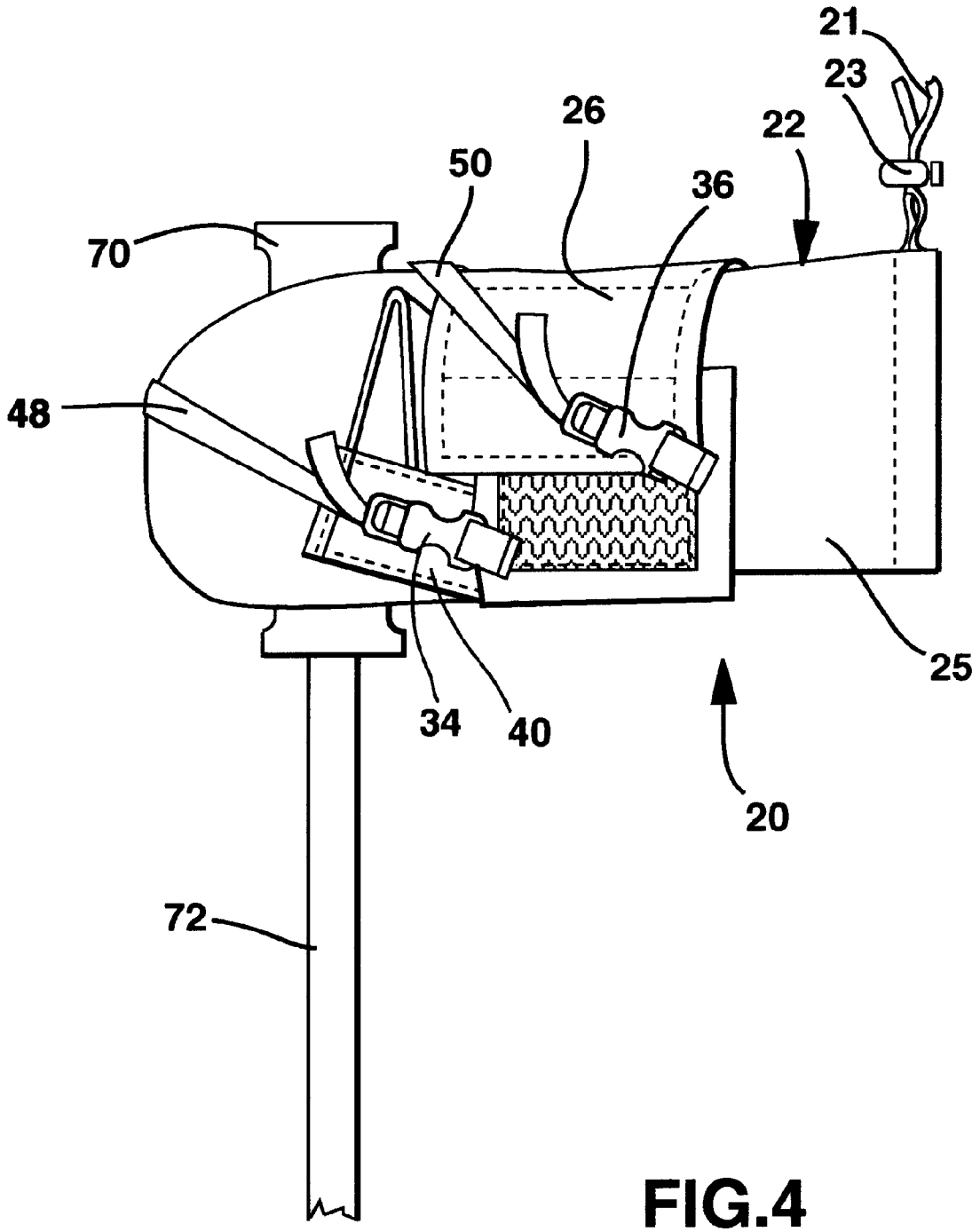
FIG. 4 is an elevational rear view of the mitten shown in FIG. 3.

In operation, a handicapped person places his hand in ski mitt 22 with his thumb in thumb pocket 27 and fingers in pocket 29. The drawstrings 25 are drawn tight through lock 23 to keep snow out of mitt 22. The arm-securing band 26 is then wrapped around the user's arm, and Velcro hooks 28 and loops 30 are fastened together to secure the mitt 22 to the user's arm. The gloved hand is positioned on a ski pole grip 70 of a ski pole 72 as shown in FIGS. 3 and 4, with the finger pocket resting on one side of grip 70 and with thumb pocket 27 on the opposite side of grip 70.

The thumb holding strap 48 is then led around grip 70 and quick release buckle portion of buckle 38 snapped together. First finger holding strap 50 is then led around grip 70 and quick release buckle portion of buckle 36 snapped together. Second finger holding strap 52 is then led around grip 70 and quick release buckle portion of buckle 34 snapped together. The thumb strap 48 and two finger holding straps 50 and 52 can then be pulled tight so that the person's hand rests comfortably around grip 70 but can not be removed from the grip.

It should also be understood that the present invention could also be used with grips of other conventional ski poles such as ski poles having outrider skis with the grip extending outward from the ski pole over the outrider ski.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims:

I claim:

1. A mitten for securing a handicapped user's hand to a grip with a thumb of the user extending along on one side of the grip and the fingers of the user extending along an opposite side of the grip comprising:

a mitt having a front face and a back face and further having an arm receiving portion and a thumb pocket and a separate finger pocket;

an arm-securing band attached to the mitt, the band being provided with connecting portions at opposite ends of the band for connecting the ends of the band together;

a thumb holding strap having one end sewn to an end of the thumb pocket of the mitt;

means for adjusting the length of the thumb holding strap;

means for releasably connecting the thumb holding strap to the arm-securing band, with the thumb holding strap extending around the grip toward the fingers of the user;

a first finger holding strap having one end sewn adjacent an end of the finger pocket;

means for adjusting the length of the first finger holding strap; and means for releasably connecting the first finger holding strap to the arm-securing band with the first finger holding strap extending around the grip toward the thumb of the user.

2. The mitten according to claim 1 wherein the means for releasably connecting the thumb holding strap to the arm-securing band includes a quick release buckle.

3. The mitten according to claim 1 wherein the means for releasably connecting the first finger holding strap to the arm-securing band includes a quick release buckle.

4. The mitten according to claim 1 wherein the means for releasably connecting the thumb holding strap to the arm-securing band is located on the back face of the mitt when the ends of the arm-securing band are connected together.

5. A mitten according to claim 1 wherein the means for releasably connecting the first finger holding strap to the arm-securing band is located on the back face of the mitt when the ends of the arm-securing band are connected together.

6. The mitten according to claim 1 further including a mitt-encircling band attached to the arm-securing band, the mitt-encircling band being provided with connecting portions at opposite ends of the band for connecting the ends of the band together with the band encircling the mitt.

7. The mitten according to claim 1 further including a padding strap secured to the arm-securing band and positioned between the mitt and the means for releasably connecting the thumb holding strap to the arm-securing band.

8. The mitten according to claim 1 further including padding attached to the arm-securing band for protecting a wrist of the user.

9. A mitten according to claim 1 further including a second finger holding strap having one end sewn to an end of the finger pocket;

means for adjusting the length of the second finger holding strap; and means for releasably connecting the second finger holding strap to the arm-securing band with the second finger holding strap extending around the grip toward the thumb of the user.

10. The mitten according to claim 9 wherein the means for releasably connecting the second finger holding strap to the arm-securing band includes a quick release buckle.

11. The mitten according to claim 9 wherein the means for releasably connecting the second finger holding strap to the arm-securing band is located on the front face of the mitt when the ends of the arm-securing band are connected together.

* * * * *